US012187513B2

(12) United States Patent
Lemsky et al.

(10) Patent No.: US 12,187,513 B2
(45) Date of Patent: Jan. 7, 2025

(54) SYSTEM FOR PACKAGING A PLURALITY OF PACKAGES ON A PALLET

(71) Applicant: SIG Services AG, Neuhausen am Rheinfall (CH)

(72) Inventors: Andreas Lemsky, Troisdorf (DE); Karol-Jan Gollnick, Linnich (DE)

(73) Assignee: SIG Services AG, Neuhausen am Rheinfall (CH)

( * ) Notice: Subject to any disclaimer, the term of this patent is extended or adjusted under 35 U.S.C. 154(b) by 0 days.

(21) Appl. No.: 17/605,631

(22) PCT Filed: Mar. 23, 2020

(86) PCT No.: PCT/EP2020/057912
§ 371 (c)(1),
(2) Date: Oct. 22, 2021

(87) PCT Pub. No.: WO2020/216543
PCT Pub. Date: Oct. 29, 2020

(65) Prior Publication Data

US 2022/0219874 A1 Jul. 14, 2022

(30) Foreign Application Priority Data

Apr. 24, 2019 (DE) ..... 10 2019 110 620.6

(51) Int. Cl.
*B65D 71/00* (2006.01)
*B65D 71/08* (2006.01)

(52) U.S. Cl.
CPC ..... *B65D 71/0096* (2013.01); *B65D 71/08* (2013.01); *B65D 2519/0086* (2013.01);
(Continued)

(58) Field of Classification Search
CPC ..... B65D 71/0096; B65D 71/08; B65D 2519/0085; B65D 2519/00043; B65D 2519/00055; B65D 2571/00074
(Continued)

(56) References Cited

U.S. PATENT DOCUMENTS 3,695,426 A * 10/1972 Engelsberger ..... B65D 75/00 53/442
4,793,490 A 12/1988 Evert
(Continued)

FOREIGN PATENT DOCUMENTS

CN 2635570 Y 8/2004
CN 107264911 A 10/2017
(Continued)

*Primary Examiner* — Steven A. Reynolds
(74) *Attorney, Agent, or Firm* — The Webb Law Firm

(57) ABSTRACT

A system for packaging a plurality of packing units on a pallet, including: a plurality of packing units made of packaging sleeves and packing-unit overwrapping, the packing-unit overwrapping enclosing the packaging sleeves; a pallet for stacking the packing units; pallet overwrapping, which encloses the packing units stacked on the pallet; and an insert provided, where: the packaging sleeves are produced from a composite material; the front side and the rear side of each packaging sleeve are separated from one another by folding edges, along which the packaging sleeve is folded flat; each packaging sleeve has two openings which are arranged on opposite sides of the packaging sleeve; each packaging sleeve has a longitudinal seam which connects two edges of the composite material to form a peripheral packaging sleeve; and the pallet overwrapping is produced from a plastics film.

9 Claims, 6 Drawing Sheets

(52) U.S. Cl.
CPC ..... *B65D 2571/00012* (2013.01); *B65D 2571/00043* (2013.01); *B65D 2571/00055* (2013.01); *B65D 2571/00074* (2013.01)

(58) Field of Classification Search
USPC ..... 206/597, 386
See application file for complete search history.

(56) References Cited

U.S. PATENT DOCUMENTS

| | | | | |
|---|---|---|---|---|
| 5,647,191 | A * | 7/1997 | Villemure | B65B 11/585 53/399 |
| 6,050,419 | A * | 4/2000 | Flanagan | B65D 71/0096 53/399 |
| 6,488,200 | B1 * | 12/2002 | Jensen, Jr. | B65D 5/323 206/508 |
| 8,231,004 | B2 * | 7/2012 | Port | B65D 71/0096 206/440 |
| 11,299,314 | B2 | 4/2022 | Dammers et al. | |
| 2005/0092637 | A1 | 5/2005 | Baechle et al. | |
| 2009/0301922 | A1 | 12/2009 | Chapman | |
| 2011/0302885 | A1 * | 12/2011 | Tousek | B65D 71/0096 53/79 |
| 2013/0026061 | A1 * | 1/2013 | Lehn | B65D 85/34 206/597 |
| 2015/0108036 | A1 | 4/2015 | Sakaguchi | |
| 2016/0332795 | A1 * | 11/2016 | Mainz | D21H 27/10 |
| 2017/0158401 | A1 | 6/2017 | Dapper et al. | |
| 2018/0362201 | A1 | 12/2018 | Schaaf | |
| 2020/0017248 | A1 * | 1/2020 | Dahlmanns | B29C 66/1122 |
| 2021/0070515 | A1 * | 3/2021 | Aretz | B65D 85/07 |

FOREIGN PATENT DOCUMENTS

| | | | |
|---|---|---|---|
| DE | 1814100 | A1 | 6/1970 |
| DE | 102014100203 | A1 | 7/2015 |
| DE | 102015110387 | A1 | 12/2016 |
| DE | 102017131262 | A1 | 7/2019 |
| EP | 1184164 | A1 | 3/2002 |
| EP | 2107009 | A1 | 10/2009 |
| EP | 2116479 | A1 | 11/2009 |
| JP | 2007237458 | A | 9/2007 |
| JP | 2008260554 | A | 10/2008 |
| JP | 2015227172 | A | 12/2015 |
| JP | 201765729 | A | 4/2017 |
| WO | 2018059799 | A2 | 4/2018 |
| WO | 2018114560 | A2 | 6/2018 |
| WO | 2018115478 | A1 | 6/2018 |
| WO | 2019120917 | A1 | 6/2019 |

* cited by examiner

SYSTEM FOR PACKAGING A PLURALITY OF PACKAGES ON A PALLET

CROSS-REFERENCE TO RELATED APPLICATIONS

This application is the United States national phase of International Application No. PCT/EP2020/057912 filed Mar. 23, 2020, and claims priority to German Patent Application No. 10 2019 110 620.6 filed Apr. 24, 2019, the disclosures of which are hereby incorporated by reference in their entirety.

BACKGROUND OF THE INVENTION

Field of the Invention

The invention relates to a system for packaging a plurality of packages made of package sleeves and a package outer packaging on a pallet, comprising: a plurality of packages made of package sleeves and a package outer packaging, with the package outer packaging enclosing the package sleeves, a pallet for stacking the packages, a pallet outer packaging, which encloses the packages stacked on the pallet, and at least one insert, which is arranged under and/or between and/or over the stacked packages, with the package sleeves being manufactured from a composite material, with each package sleeve having a front side and a rear side, with the front side and the rear side of each package sleeve being separated from one another by folding edges, along which the package sleeve is folded together flat, with each package sleeve having two openings, which are arranged on opposing sides of the package sleeve, with each package sleeve having a longitudinal seam, which connects two edges of the composite material to a circumferential package sleeve and with the pallet outer packaging being manufactured from a plastic film.

Description of Related Art

Packages can be manufactured in different manners and from the most varied materials. A popular possibility for manufacturing them is to manufacture a blank from the packaging material, from which a packaging sleeve firstly results by folding and other steps and lastly a package results. This type of manufacture has, inter alia, the advantage that the blanks and package sleeves are very flat and therefore can be stacked in a space-saving manner. In this manner, the blanks or package sleeves can be manufactured at a different location to where the folding and filling of the package sleeves takes place. Composite materials are often used as the material, for example a composite made of a plurality of thin layers of paper, cardboard, plastic or metal, in particular aluminium. Packages of this type are in particular widely found in the foodstuffs industry and are preferably used there to package foodstuffs, which have at least one liquid component.

A first manufacturing step often consists of generating a circumferential package sleeve from a blank by folding and welding or adhering a seam. The flat package sleeves are often stacked and packaged in order to take them to the location for filling the package sleeves. Packages with different (package) outer packaging are known for this purpose from the prior art.

In the case of a first known package (FIG. 2A), a rigid carton made of corrugated cardboard is used as the package outer packaging. Outer packaging of this type offers very good mechanical protection for the package sleeves stored therein. A disadvantage of outer package of this type is, however, the very low elasticity, which does not allow the package to be compressed and therefore to be transported in a space-saving manner. Additionally, a rigid outer packaging has the disadvantage of having to be broken down after removing the package sleeves in order to take up less volume. Additionally, dust results when breaking down rigid outer packaging which is highly undesirable in areas with high requirements for hygiene, for example in the environment of a filling machine for foodstuffs.

In the case of a further known package (FIG. 2B), the package outer packaging is, in contrast, formed from paper, the package sleeves are thus wrapped in paper. An outer packaging of this type can therefore be easily folded together after removing the package sleeves and disposed of. A disadvantage of such an outer packaging is, however, the low elasticity and low tear resistance of the paper. The package can therefore not receive any package sleeves folded together in a space-saving manner inside it since the restoring forces would lead to the paper tearing.

Additionally, it is hardly possible in the case of the known outer packaging made of paper or corrugated cardboard to reduce the gas exchange between the volume enclosed in the outer packaging and the environment to an extent that is desirable or required from a microbiological point of view. The mentioned disadvantages also occur when a plurality of packages of this type are stacked on a pallet for transport purposes and the packages, with the pallet and a pallet outer packaging, form a system for packaging a plurality of packages. Against this background, the object underlying the invention is to configure and further develop the system described at the outset and previously explained in more detail whilst avoiding the previously described disadvantages in such manner that a space-saving, cost-effective and safe transport of package sleeves is made possible.

This object is achieved in the case of a system according to the invention in that the package outer packaging is manufactured from a plastic film.

SUMMARY OF THE INVENTION

A system according to the invention serves to package a plurality of packages on a pallet, with each package being formed from a group of package sleeves and a package outer packaging. The system comprises a plurality of packages made of package sleeves and (in each case) a package outer packaging, with the package outer packaging enclosing the package sleeves belonging to its package. The system also comprises a pallet for stacking the packages, and the packages can preferably be stacked in a plurality of layers on the pallet and each layer preferably being formed from a plurality of packages. The system also comprises a pallet outer packaging manufactured from a plastic film, which encloses the package stacked on the pallet, and preferably also parts of the pallet. The packages stacked on the pallet are preferably wrapped by the pallet outer packaging, of a plastic film, in the circumferential direction, with multiple wrapping operations preferably taking place.

Lastly, the system comprises at least one insert, which can be arranged under and/or between and/or over the packages stacked on the pallet. The insert can for example have anti-slip properties and/or also serve as a carrier material for means for stabilising/disinfecting. A further function of the insert can be to increase the dimensional stability of the stacked packages. The package sleeves packaged into the packages are manufactured from a composite material and each have a front side and a rear side, with the front side and the rear side of each package sleeve being separated from one another by folding edges, along which the package sleeve is folded together flat. Each package sleeve has two openings, which are arranged at opposing sides of the package sleeve. Additionally, each package sleeve has a longitudinal seam, which connects two edges of the composite material to a circumferential package sleeve. The composite material of the package sleeves can have a thickness in the range of between 150 g/m$^2$ and 500 g/m$^2$, in particular between 200 g/m$^2$ and 350 g/m$^2$.

According to the invention, provision is made for the package outer packaging to be manufactured from a plastic film. Plastic films are characterised by low costs, a high elasticity and a high tear resistance. Unlike rigid (package) outer packaging (e.g. cartons made of corrugated cardboard), it is possible to compress the package and transport it in a space-saving manner. Unlike less tear-resistant (package) outer packaging (e.g. made of paper), it is possible to receive compressed package sleeves inside, without the plastic film tearing. The plastic film can for example be manufactured from PE (polyethylene). The plastic film is preferably antistatic since this has advantages in the case of an extension of the film and when stacking/unstacking a plurality of finished packages. Additionally, the plastic film can preferably be compressed and/or laminated. The plastic film should also be as temperature resistant as possible. Different requirements can be set for the plastic film of the package outer packages and for the plastic film of the pallet outer packaging. The plastic film of the package outer packaging can have a thickness in the range of between 10 μm and 100 μm, in particular between 15 μm and 50 μm, preferably between 30 μm and 40 μm (e.g. roughly 35 μm). The plastic film of the pallet outer packaging can have a thickness in the range of between 10 μm and 150 μm, in particular between 20 μm and 30 μm (e.g. roughly 23 μm). Very thin films have the advantage of low costs and low weight, while thicker films have a greater tear resistance. Additionally, thin films are less suited for shrinking since they tear at high temperatures; similarly, thick films are less suited for stretching since large forces would be required for deformation. Films with a thickness in the indicated region have been found to be a good compromise between these requirements. The thickness of the film can for example be measured according to DIN 53370.

According to one configuration of the system, provision is made for a base layer to be provided as the insert, which is arranged on the pallet under the packages. The base layer is preferably placed directly on the pallet; it is therefore arranged between the pallet and the lowermost layer of packages. The size of the base layer preferably corresponds roughly to the size of the pallet (e.g. 1200 mm×800 mm or 1200 mm×1000 mm) in order to be able to completely cover the pallet and to offer a flat, stable and anti-slip support for the stacking of the packages. The base layer is preferably arranged outside of the package outer packaging, but inside the pallet outer packaging. The base layer is preferably manufactured from paper or cardboard and can have a thickness of at least 300 g/m$^2$, in particular of at least 400 g/m$^2$, preferably of roughly 500 g/m$^2$. Alternatively or in addition to a base layer made of paper or cardboard, a base layer made of a film can be provided, with a thickness of at least 100 g/m$^2$ being preferred.

A further configuration of the system makes provision for at least one intermediate layer to be provided as the insert, which is arranged between a plurality of layers of packages stacked on top of one another on the pallet. The number of intermediate layers preferably corresponds to the number of intermediate levels present between the stacked layers of the packages; in the case of five layers of stacked packages, four intermediate layers should thus for example preferably be provided. The intermediate layers should be arranged between the layers of packages stacked on one another. The size of the intermediate layers preferably also corresponds roughly to the size of the pallet (e.g. 1200 mm×800 mm or 1200 mm×1000 mm) or is slightly below it in order to be able to cover or reach all packages of a layer. The intermediate layers are preferably arranged outside of the package outer packaging, but inside the pallet outer packaging. The intermediate layers preferably also have anti-slip properties in order to be able to stabilise the stacking. The intermediate layers are preferably manufactured from paper or cardboard and can have a thickness of at least 80 g/m$^2$, in particular of at least 90 g/m$^2$, preferably of roughly 100 g/m$^2$. Alternatively or in addition to an intermediate layer made of paper or cardboard, an intermediate layer made of a film can be provided, with a thickness of at least 100 g/m$^2$ being preferred.

According to a further design of the system, a cover is provided as the insert, which is arranged on the uppermost layer of packages. The cover should be placed on the uppermost layer of packages (or on an intermediate layer located there) and therefore be arranged at the very top. The cover therefore serves to finish the upper end of the stacking. The size of the cover also preferably corresponds roughly to the size of the pallet (e.g. 1200 mm×800 mm or 1200 mm×1000 mm) in order to be able to cover or reach all packages of a layer. The cover is preferably also arranged outside of the package outer packaging, but inside the pallet outer packaging. The cover is preferably manufactured from paper or cardboard and can have a thickness of at least 80 g/m$^2$, in particular of at least 90 g/m$^2$, preferably of roughly 100 g/m$^2$. Alternatively or in addition to a cover made of paper or cardboard, a cover made of a film can be provided, with a thickness of at least 100 g/m$^2$ being preferred. The cover can also be configured in a multi-layered manner, with the first layer, which is preferably manufactured from paper or cardboard, for example being responsible for the dimensional stability and the protection of the packages and with the second layer, which is preferably manufactured from a film, for example serving to protect the packages against moisture.

In regard to the insert, according to a further configuration of the system, provision is made for the insert, in particular the intermediate layer, to be arranged outside of the package outer packaging, but inside the pallet outer packaging. Unlike inserts, which are arranged inside the package outer packaging, package outer packaging arranged on the outside has the advantage that it can be larger than the package. As a result, it is possible that the insert, in particular the intermediate layer, can cover or reach all packages of a layer. In this manner, the insert can contribute to a stabilisation of the stacking, for example due to anti-slip properties.

According to a further design of the system, provision is made for at least one insert, in particular at least one intermediate layer, to comprise a means for sterilisation and/or disinfection. All inserts, or at least all intermediate layers, preferably comprise means for sterilisation and/or disinfection. The insert, in particular the intermediate layer, can thus serve as a load carrier, which absorbs active substances, for example a sterilising agent. In this manner, the packages stacked on the pallet and the package sleeves packaged therein can also remain sterile for extended transports and/or unfavourable environmental influences (e.g. heat). $H_2O_2$ is for example used for sterilisation/disinfection.

A further configuration of the system is characterised by at least one edge protector being arranged between the packages stacked on top of one another on the pallet and the pallet outer packaging. An edge protector is preferably provided on all four vertically running edges of the pallet (with the packages stacked thereon). The edge protector offers protection against mechanical influences. The edge protector remains in its position since it is arranged inside of the pallet outer packaging and is therefore pressed against the stacked packages by the pallet outer packaging. The edge protector can for example be manufactured from cardboard, in particular from corrugated cardboard.

According to another design of the system, provision is made for the pallet outer packaging to be manufactured from a UV protective film. A UV protective film is understood as a film through which only a small proportion of ultraviolet light or even no ultraviolet light penetrates, with ultraviolet light being designated as light with wavelengths of 380 nm or less, for example light with wavelengths in the range of between 100 nm and 380 nm. A large proportion of the ultraviolet light should therefore not pass through, but for example be reflected and/or absorbed. The UV radiation is preferably reflected and/or absorbed by a single-layered UV protective film by up to at least 50% (transmittance 50%) and preferably the UV radiation of a multi-layered (in particular four-layered) or UV protective film wound multiple times (in particular four times) is reflected and/or absorbed by up to at least 90%, in particular at least 95%, preferably at least 98% (transmittance 10%). The UV protective film can itself be formed in a multi-layered manner and/or be wound multiple times around the pallet. Through the UV protective film, the loading of the pallet, in particular the package sleeves, can be protected against the negative influence of UV radiation, for example from fading of the printed package sleeves or heating of the package sleeves. In contrast, the UV protective film is preferably light-permeable in the range of the visible light (wavelengths of between 380 nm and 780 nm) (high transmittance values) such that the content packaged with the film can be discerned (e.g. colours, patterns and other information).

According to a further configuration of the system, provision is made for the plastic film of the package outer packaging and/or the plastic film of the pallet outer packaging to be printed. By the plastic film being printed directly, necessary information for the transport (e.g. sender, recipient, content, coding), can be applied directly on the package outer packaging and/or the pallet outer packaging without separate labels, adhesives or the like having to be secured for this purpose.

In a further configuration of the system, provision can be made for the plastic film of the package outer packaging and/or the plastic film of the pallet outer packaging to have stretch properties and/or shrink properties. A stretch film is understood as a film which has a very high extendibility, in particular an elongation at break of at least 100%, in particular at least 150%, at least 200% or at least 300% (for example measured according to DIN EN ISO 527). A high extendibility has in particular the advantage that the film does not tear even at high stress. A shrink film is understood as a film which, under certain conditions, in particular heating and subsequent cooling, contracts and therefore "shrinks". The film preferably has a shrink value of at least 5%, in particular at least 10%, at least 20%, at least 30% or at least 40%. Films with shrink properties have the advantage that the film is laid more precisely on the contour around the content to be packaged and said contents can possibly even be compressed. It can be provided that the stretch properties and/or shrink properties of the film are direction-dependent. In particular, it can be provided that the stretch properties and/or the shrink properties of the film are different in the longitudinal direction and in the transverse direction, with the longitudinal direction and the transverse direction forming an angle of 90°.

According to a further design of the system, provision is lastly made for the package outer packaging to combine the package sleeves in such manner that in the stacking direction are arranged at least 4.0 package sleeves per cm, in particular at least 4.5 package sleeves per cm, in particular at least 5.0 package sleeves per cm, in particular at least 5.5 package sleeves per cm, in particular at least 6.0 package sleeves per cm, in particular at least 6.5 package sleeves per cm, in particular at least 6.75 package sleeves per cm, in particular at least 7.0 package sleeves per cm, in particular at least 7.25 package sleeves per cm or at least 7.5 package sleeves per cm. The stacking direction is understood as the direction which runs through all stacked package sleeves; the stacking direction can in particular run roughly at right angles to the front sides and rear sides of the package sleeves. Due to the elasticity and high tear resistance of the plastic film, a high stacking density can be achieved. This can for example be achieved by the package sleeves being pushed together and compressed in the stacking direction and in this state being wrapped by a pretensioned film. Due to the pretensioning of the film, the film is pulled together again after wrapping the package sleeves and thus prevents the package sleeves being pushed back out of the still open ends of the film by restoring forces. The indicated lower limits for the stacking density can be combined with an upper limit for the stacking density which can for example be 8 package sleeves per cm, 9 package sleeves per cm or 10 package sleeves per cm. Higher stacking densities can lead to damage to the package sleeves. If a plurality of rows of package sleeves are combined in a single package, the values are increased by a factor corresponding to the number of rows, i.e. in the case of two rows for example a lower limit of at least 8.0 to 15 package sleeves per cm and an upper limit of 16 to 20 package sleeves per cm.

BRIEF DESCRIPTION OF THE DRAWINGS

The invention is explained in more detail below on the basis of a drawing representing only one preferred exemplary embodiment. In the drawing is shown.

DESCRIPTION OF THE INVENTION

Figure 1A:
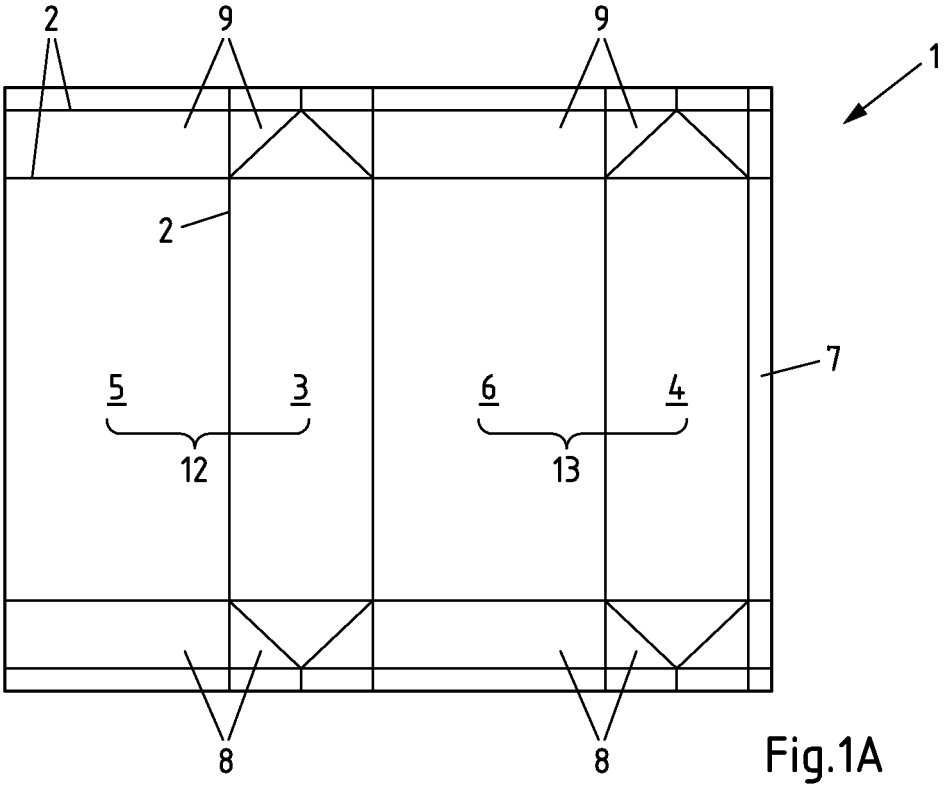
Fig.1A Prior Art
FIG. 1A: a blank for folding a package sleeve known from the prior art.

In FIG. 1A, a blank 1 known from the prior art is represented, from which a package sleeve can be formed. The blank 1 can comprise a plurality of layers of different materials, for example paper, carton, cardboard, plastic or metal, in particular aluminium. The blank 1 has a plurality of fold lines 2, which should facilitate the folding of the blank 1 and divide the blank 1 into a plurality of surfaces. The blank 1 can be subdivided into a first side surface 3, a second side surface 4, a front surface 5, a rear surface 6, a sealing surface 7, base surfaces 8 and gable surfaces 9. A package sleeve is formed from the blank 1 by folding the blank 1 in such manner that the sealing surface 7 can be connected, in particular welded with the front surface 5.

Figure 1B:
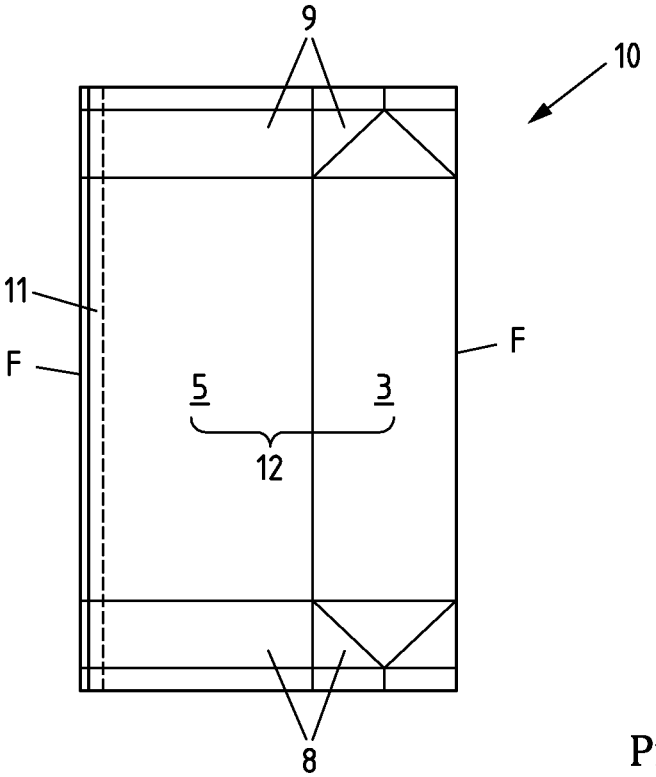
Fig.1B Prior Art
FIG. 1B: a package sleeve known from the prior art, which is formed by the blank shown in FIG. 1A, in the folded-flat state.

FIG. 1B shows a package sleeve 10 known from the prior art in the folded-flat state. The regions of the package sleeve already described in connection with FIG. 1A are provided in FIG. 1B with corresponding reference numerals. The package sleeve 10 is formed from the blank 1 shown in FIG. 1A. To this end, the blank 1 is folded in such manner that the sealing surface 7 and the front surface 5 are arranged overlapping such that the two surfaces can be welded flat with one another. As a result, there is a longitudinal seam 11. The package sleeve 10 is represented in FIG. 1B in a state which is folded flat along two fold lines F. In this state, a side surface 4 (concealed in FIG. 1B), is located under the front surface 5 while the other side surface 3 on the rear surface 6 (concealed in FIG. 1B). The front surface 5 and the side surface 3 adjoined thereto therefore form a front side 12 of the package sleeve 10 and the rear surface 6 and the side surface 6 adjoined thereto therefore form a rear side 13 of the package sleeve 10. In the folded-flat state, a plurality of package sleeves 10 can be stacked in a particularly space-saving manner. Therefore, the package sleeves 10 are often stacked at the location of manufacture and transported in a stacked manner to the location of filling. Only there are the package sleeves 10 unstacked and unfolded in order to be able to fill them with contents, for example foodstuffs. The filling can take place under aseptic conditions. The foodstuffs can contain at least one liquid component.

Figure 2A:
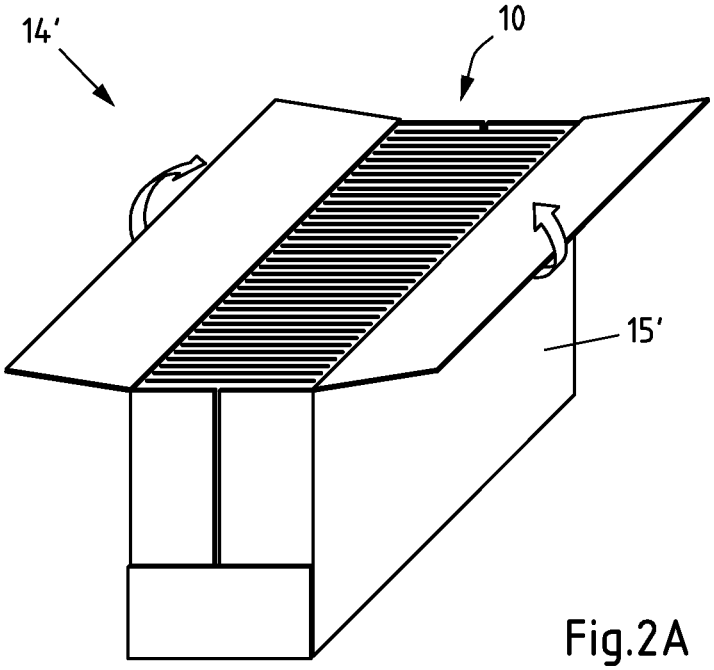
Fig.2A Prior Art
FIG. 2A: a first package known from the prior art made of outer packaging and a plurality of package sleeves.
Figure 2B:
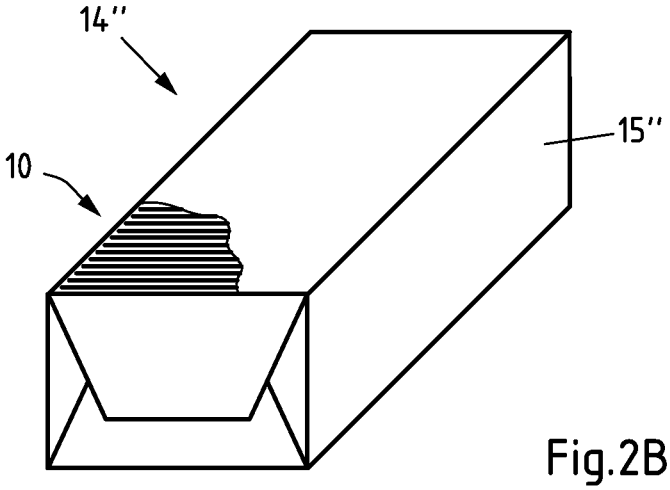
Fig.2B Prior Art
FIG. 2B: a second package known from the prior art made of outer packaging and a plurality of package sleeves.

FIG. 2A shows a first package 14' known from the prior art made of a package outer packaging 15' and a plurality of package sleeves 10 and FIG. 2B shows a second package 14" known from the prior art made of a package outer packaging 15" and a plurality of package sleeves 10. In the case of the package 14' shown in FIG. 2A, the package outer packaging 15' is formed from corrugated cardboard and is therefore very rigid. The package outer packaging 15' from FIG. 2A therefore offers very good mechanical protection for the package sleeves 10 stored therein. A disadvantage of the package outer packaging 15' is, however, the very low elasticity which does not allow the package 14' to be compressed and therefore transported in a space-saving manner. Additionally, a rigid outer packaging has the disadvantage of having to be broken down after removing the package sleeves 10 in order to take up less volume. In the case of the package 14" shown in FIG. 2B, the package outer packaging 15" is formed from paper, the package sleeves 10 are thus wrapped in paper like a gift. The package outer packaging 15" can therefore be easily folded together after removing the package sleeves 10 and disposed of. A disadvantage of the package outer packaging 15" is, however, the low elasticity and low tear-resistance of the paper. The package 14" can therefore not receive package sleeves 10 compressed in a space-saving manner inside it since the restoring forces would lead to the paper tearing.

Figure 3B:
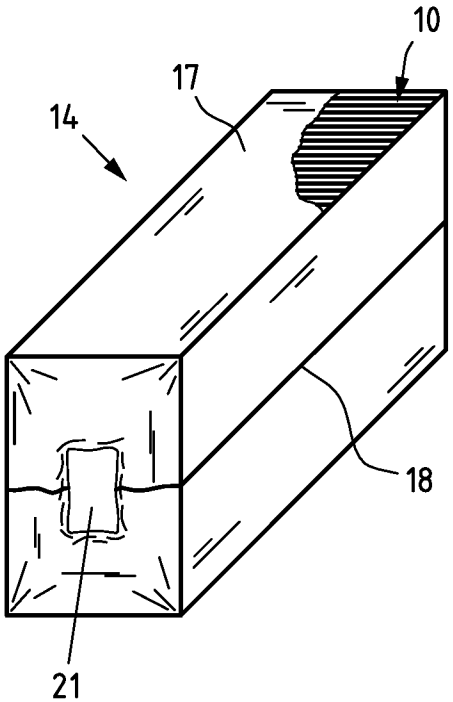
FIG. 3B: a package made of package sleeves and a package outer packaging.
Figure 3A:
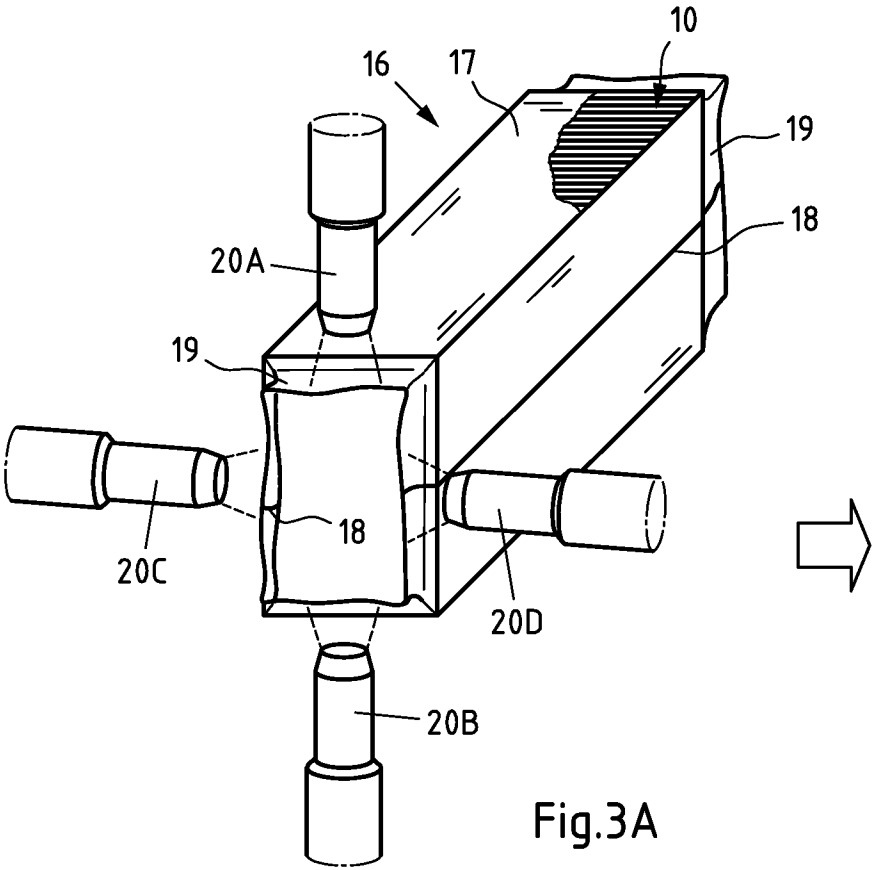
FIG. 3A: a package sleeve group with a package outer packaging.

FIG. 3A shows a package sleeve group 16 with a package outer packaging and FIG. 3B shows a package 14 manufactured therefrom. For better understanding, FIG. 3A and FIG. 3B are perspective representations. The regions, which have already been previously described, are provided in FIG. 3A and FIG. 3B with corresponding reference numerals. The package outer packaging 15 is formed from an elastic plastic film 17 in FIG. 3A and in FIG. 3B. The plastic film can have a weld seam 18 or also a plurality of weld seams 18, for example two weld seams 18 arranged at opposite sides. The protruding ends 19 of the plastic film 17 can be deflected at both end faces of the package sleeve group 16 by means of hot air. To this end, four hot air nozzles 20A, 20B, 20C and 20D are preferably arranged at both end faces of the package sleeve group 16 of which only the front nozzles are shown. The application of the protruding ends 19 of the plastic film 17 leads to them laying on the end surfaces of the package sleeve group 16 and they can be welded together there, as is discernible in FIG. 3B where a finished package 14 is represented. Since the protruding ends 19 of the plastic film 17 are very short, the end faces of the package sleeve group 16 cannot be completely covered with plastic film when the protruding ends 19 are laid on the end surface and welded together. It is in fact discernible in FIG. 3B that a type of window 21 is formed in the centre of the end surfaces. Alternatively to this, the protruding ends 19 of the plastic film 17 can also be designed longer, whereby a package 14 results, which is sealed on its end faces completely by plastic film 17. It is also discernible that at both sides of the package 14 weld seams 18 are laid on the end faces. Hot air is firstly preferably provided into the opposing nozzles 20A and 20B so that the protruding upper and lower ends 19 of the plastic film 17 lay on the end face of the package sleeve group 16, before the nozzles 20C and 20D are then activated such that all protruding ends 19 are laid flat and welded with one another. It is clear that in this case welding should not take place between the plastic film 17 and the coating of the outer package sleeve 10 of the package sleeve group 16. Lastly, it is clearly discernible in FIG. 3A that the package sleeve group 16 in the region of its end faces both at the corners and also along its edges tightly comprises the package sleeve group 16, whereby a fixed unit results which is dimensionally stable and therefore easy to transport.

Alternatively to the configuration shown in FIGS. 3A and 3B, provision can be made for the plastic film 17 not to have weld seams. For example, the lateral weld seams running along the stacking direction can be dispensed with since the plastic film 17 is already manufactured in tubular shape (e.g. by extrusion). Additionally, provision can be made for the plastic film 17 to be pouch-shaped such that it is already sealed at its one end and only needs to be sealed on the front end face.

Figure 4:
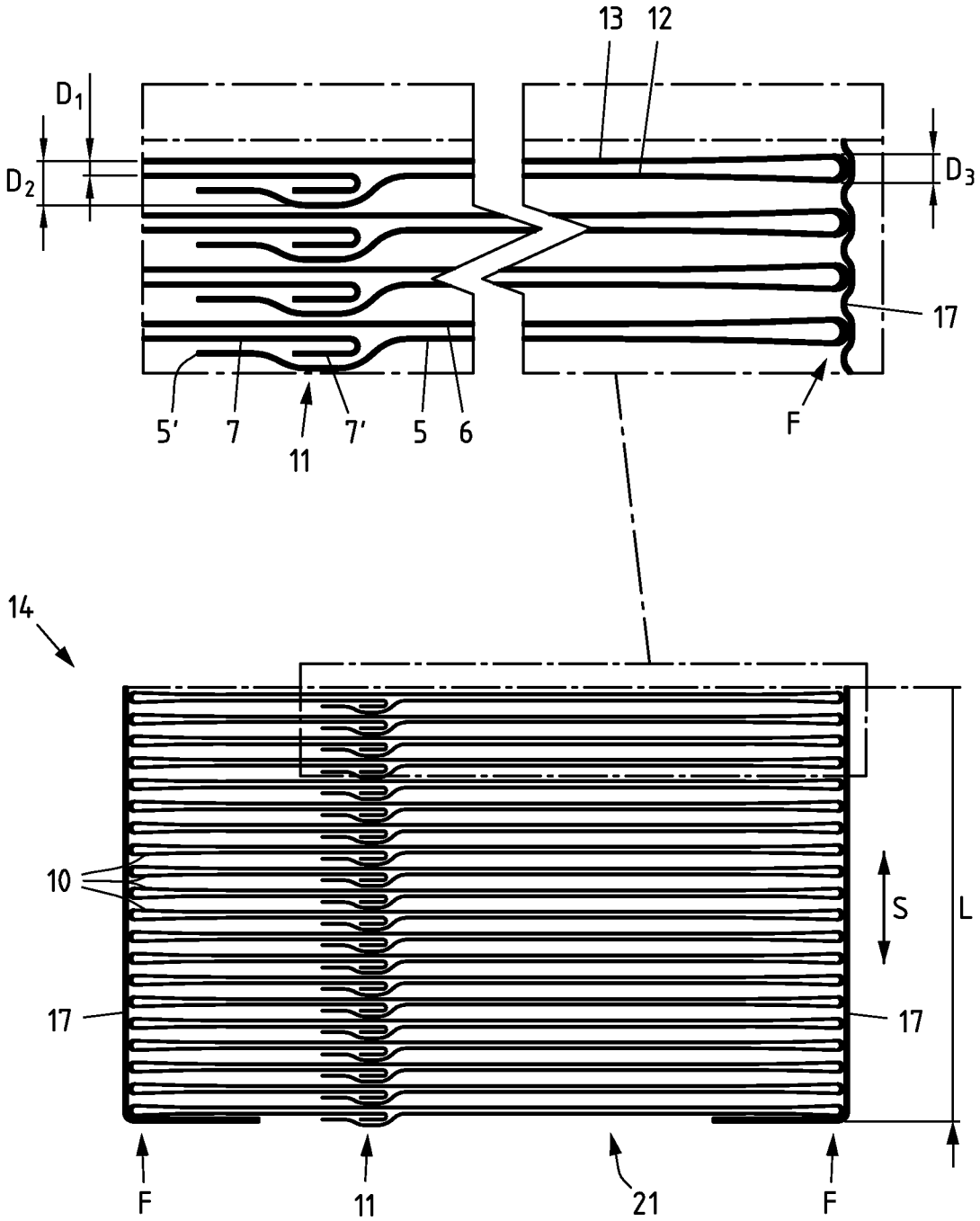
FIG. 4: a package made of package sleeves and a package outer packaging in a top view.

FIG. 4 shows a package 14 according to the invention made of a plurality of package sleeves 10 and a package outer packaging in a top view. The regions, which have already been previously described, are also provided with corresponding reference numerals in FIG. 4. Twenty package sleeves 10 are shown which, in a tightly stacked manner, are surrounded and held together by a plastic film 17. The stacking direction S is represented schematically by a double arrow and runs perpendicular through the package sleeves 10. The plastic film 17 forms, in the region of the lower end surface, a window 21, as has already been described in connection with FIG. 3B. Each package sleeve 10 discernibly has three regions with increased thickness: the regions of the two folding edges F and the region of the longitudinal seam 11. This is particularly clear in the enlarged section of FIG. 4 (represented at the top). The package sleeves 10 have a minimum thickness $D_1$, which is lower than the thickness $D_2$ in the region of the longitudinal seam 11 and also smaller than the thickness $D_3$ in the region of the folding edges F. The increased thickness $D_2$ in the region of the longitudinal seam 11 is justified in that the end region 5' of the front surface 5 and the end region 7' of the sealing surface 7 form an overlap in the region of the longitudinal seam 11. The package sleeve 10 thus has an at least three-layered structure, instead of a two-layered structure, in the region of the longitudinal seam 11. The thickness $D_1$ of the package sleeve 10 is for example in the range of between 0.5 mm and 1.5 mm, while the increased thickness $D_2$ of the package sleeve 10 is for example in the range of between 0.6 mm and 3.0 mm. The transition between the different thicknesses is also called a "layer jump". The plastic film 17 can be laid around the package sleeves 10 in the region of the folding edges F and can therefore be formed in an undulating manner in this region (discernible in the enlarged region of FIG. 4). This can be achieved through the elasticity of the plastic film 17 and/or by using a shrink film.

In addition to the overlap, one or both end regions 5', 7' can be folded over. Folding over the inner end region (in FIG. 4: end region 7') has the advantage that only the innermost layer of the material of the package sleeve 10 can come into contact with the content of the package to be manufactured therefrom. This results in the other layers of the material of the package sleeve 10, for example a middle layer made of paper, carton or cardboard being separated from the content of the package. In this manner, both the leak-tightness of the package is ensured and hygienic requirements are met. A complete folding-over of the inner end region 7' would, however, lead to a further increase of the thickness of the package sleeve 10 in the region of the longitudinal seam 11. Provision can therefore be made for only some of the layers of the end region 7', in particular the innermost layer of the end region 7' to be folded over. To this end, the other layers are separated or removed prior to folding over.

As is discernible in FIG. 4, the package sleeves 10 can only be stacked as dense as their density regions allow. These are in particular the regions of the two folding edges F and the region of the longitudinal seam 11. The thickness of the stacking of the package sleeves 10 can be measured and indicated by the number of the package sleeves 10 per unit of length L being indicated, with the unit of length L being measured along the stacking direction S. In order to obtain the most precise information about the stack density, a number of package sleeves 10 should be counted and their number divided by the unit of length L (e.g. one hundred package sleeves 10). The stack density is preferably at least 4.0 package sleeves per cm, in particular at least 4.5 package sleeves per cm, in particular at least 5.0 package sleeves per cm, in particular at least 5.5 package sleeves per cm, in particular at least 6.0 package sleeves per cm, in particular at least 6.5 package sleeves per cm, in particular at least 6.75 package sleeves per cm, in particular at least 7.0 package sleeves per cm, in particular at least 7.25 package sleeves per cm or at least 7.5 package sleeves per cm.

Figure 5:
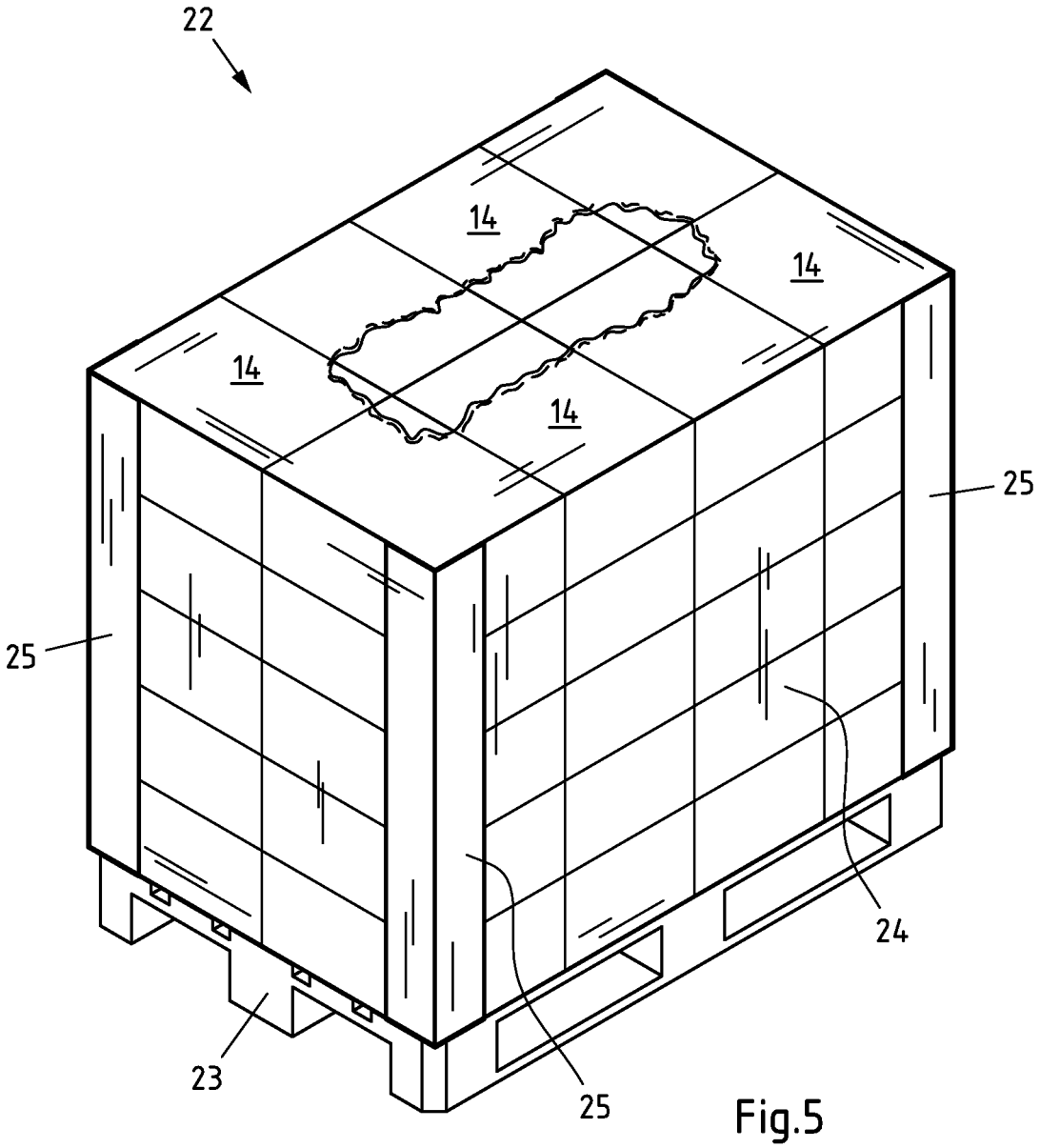
FIG. 5: a system according to the invention for packaging a plurality of packages on a pallet in a perspective view.

A system 22 according to the invention for packaging a plurality of packages 14 on a pallet 23 is represented in FIG. 5 in a perspective view. The regions, which have already been previously described, are also provided with corresponding reference numerals in FIG. 5. The system 22 comprises a pallet 23 for stacking the packages 14, with each package 14 being formed from package sleeves 10 and a package outer packaging 15. The package outer packaging 15 is manufactured from a plastic film 17. The system 22 also comprise a pallet outer packaging 24, which surrounds the packages 14 stacked on the pallet 23 and is also manufactured from a plastic film, for example from a shrink film and/or stretch film. The system 22 can also comprise an edge protector 25, which should protect the package 14 during transport and is for example manufactured from reinforced cardboard, in particular corrugated cardboard. The system 22 also has at least one insert 26 (not represented in FIG. 5) about which more detail will be given in connection with FIG. 6.

Figure 6:
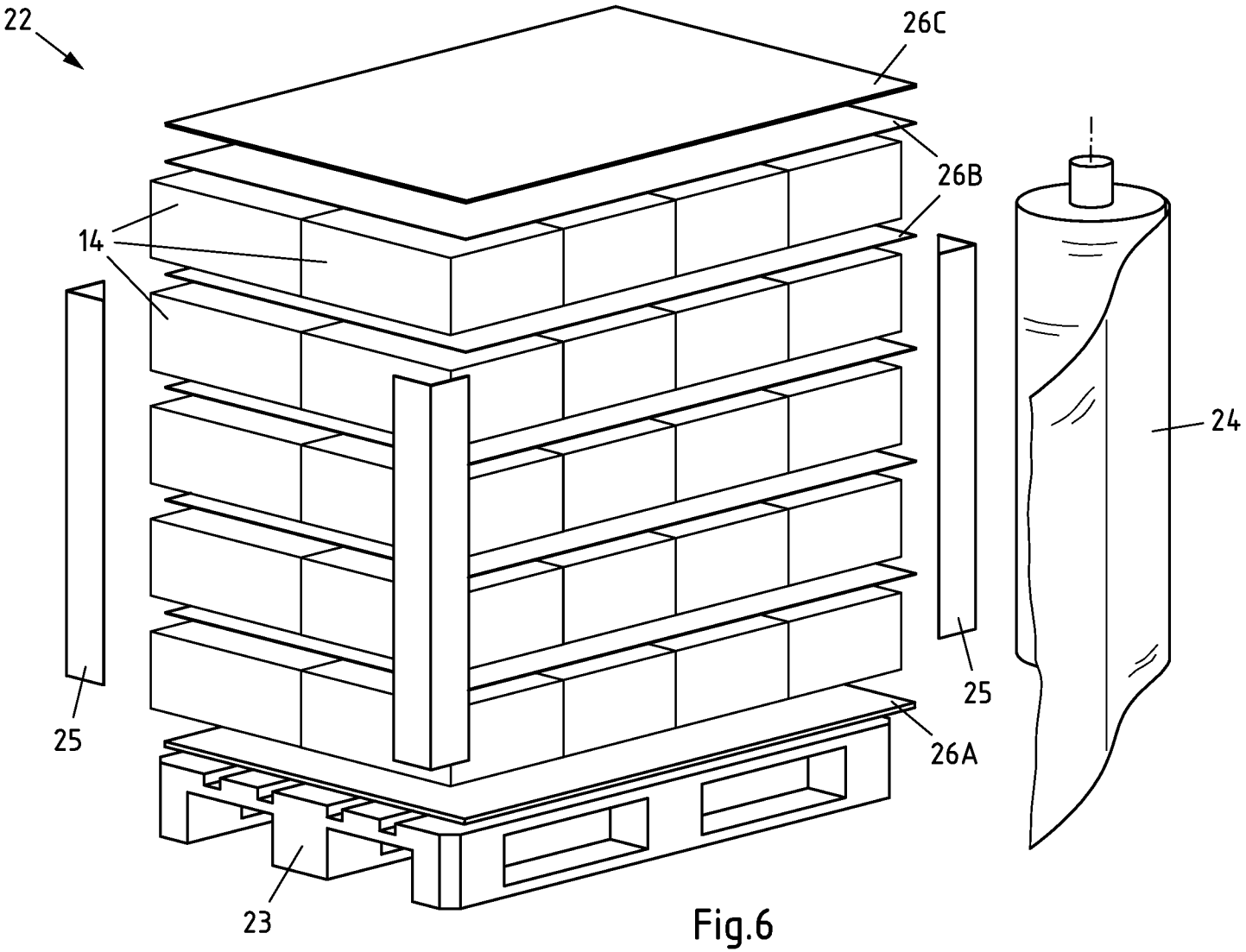
FIG. 6: the system according to the invention from FIG. 5 in an exploded view.

FIG. 6 shows the system 22 according to the invention for packaging a plurality of packages 14 made of package sleeves 10 on a pallet 23 in an exploded view. The regions of the system, which have already been previously described, are also provided with corresponding reference numerals in FIG. 6. In the exploded view, the individual components of the system 22 are represented detached and spaced apart from one another, with in particular the shape and arrangement of the different inserts 26 being visible:

The first, lowermost, insert is a base layer 26A, which is laid directly on the pallet 23 and is therefore arranged between the pallet 23 and the lowermost layer of packages 14. The size of the base layer 26A preferably corresponds roughly to the size of the pallet 23 (e.g. 1200 mm×800 mm or 1200 mm×1000 mm) in order to be able to completely cover the pallet 23 and to provide a flat, stable and anti-slip support for the stacking of the packages 14. The base layer 26A is arranged outside of the package outer packaging 15, but inside the pallet outer packaging 24. The base layer 26A is preferably manufactured from paper or cardboard and can have a thickness of at least 300 g/m$^2$, in particular of at least 400 g/m$^2$, preferably of roughly 500 g/m$^2$.

The second type of inserts are one or a plurality of intermediate layers 26B which are arranged between the layers of packages 14 stacked on top of one another. The size of the intermediate layers 26B preferably corresponds roughly to the size of the pallet 23 (e.g. 1200 mm×800 mm or 1200 mm×1000 mm) or is slightly below it in order to be able to cover or reach all packages 14 of a layer. The intermediate layers 26B are arranged outside of the package outer packaging 15, but inside of the pallet outer packaging 24. The intermediate layers 26B also preferably have anti-slip properties in order to be able to stabilise the stacking. The intermediate layers 26B are preferably manufactured from paper or cardboard and can have a thickness of at least 80 g/m$^2$, in particular of at least 90 g/m$^2$, preferably of roughly 100 g/m$^2$.

The third uppermost insert is a cover 26C, laid on the upper most layer of packages 14 or on the intermediate layer 26B located there and is therefore arranged at the very top. The cover 26C therefore serves to finish the upper end of the stacking. The size of the cover 26C also preferably corresponds roughly to the size of the pallet 23 (e.g. 1200 mm×800 mm or 1200 mm×1000 mm) in order to be able to cover or reach all packages 14 of a layer. The cover 26C is preferably also arranged outside of the package outer packaging 15, but inside the pallet outer packaging 24. The cover 26C is preferably manufactured from paper or cardboard and can have a thickness of at least 80 g/m$^2$, in particular of at least 90 g/m$^2$, preferably of roughly 100 g/m$^2$. Alternatively or in addition to a cover 26C made of paper or cardboard, a cover 26C made of a film can be provided, with a thickness of at least 100 g/m$^2$ being preferred. The cover 26C can also be configured in a multi-layered manner, with the first layer, which is preferably manufactured from paper or cardboard, for example being responsible for the dimensional stability and the protection of the packages 14 and wherein the second layer, which is preferably manufactured from a film, for example serving to protect the packages 14 against moisture.

LIST OF REFERENCE NUMERALS

1: blank
2: fold line
3, 4: side surface
5: front surface
5': end region (of the front surface 5)
6: rear surface
7: sealing surface
7': end region (of the sealing surface 7)
8: base surface
9: gable surface
10: package sleeve
11: longitudinal seam
12: front side (of the package sleeve 10)
13: rear side (of the package sleeve 10)
14, 14', 14": package
15, 15', 15": package outer packaging
16: package sleeve group
17: plastic film
18: weld seam
19: end (of the plastic film 16)
20A, 20B, 20C, 20D: hot air nozzles
21: window
22: system
23: pallet
24: pallet outer packaging
25: edge protector
26: insert
26A: base layer
26B: intermediate layer
26C: cover
$D_1$: minimum thickness (of the package sleeve 10)
$D_2$: thickness (in the region of the longitudinal seam 11)
$D_3$: thickness (in the region of the folding edges F)
L: unit of length
F: folding edge (of the package sleeve 10)
S: stacking direction

The invention claimed is:

1. A system for packaging a plurality of packages made of package sleeves and a package outer packaging on a pallet, comprising:

the plurality of packages made of package sleeves and a package outer packaging, wherein the package outer packaging encloses the package sleeves at least in sections from all sides, a pallet for stacking the plurality of packages, a pallet outer packaging which encloses the plurality of packages stacked on the pallet, and at least one insert which is arranged under and/or between and/or over the plurality of stacked packages, wherein the package sleeves are manufactured from a composite material, wherein each package sleeve has a front side and a rear side, wherein the front side and the rear side of each package sleeve are separated from one another by folding edges, along which each package sleeve is folded together flat, wherein each package sleeve has two openings, which are arranged on opposing sides of the package sleeves, wherein each package sleeve has a longitudinal seam which connects two edges of the composite material to a circumferential package sleeve, wherein the pallet outer packaging is manufactured from a plastic film, wherein the package outer packaging is manufactured from a plastic film, wherein at least one intermediate layer is provided as the at least one insert which is arranged between a plurality of layers of packages stacked one on top of another on the pallet, wherein the at least one intermediate layer is arranged outside of the package outer packaging, but inside the pallet outer packaging, and wherein at least one intermediate layer comprises a means for absorbing a sterilisation and/or disinfection agent.

2. The system according to claim 1, wherein a base layer is provided as the insert which is arranged on the pallet under the packages.

3. The system according to claim 1, wherein a cover is provided as the insert which is arranged on the uppermost layer of packages.

4. The system according to claim 1, wherein at least one edge protector is to be arranged between the packages stacked one on top of another on the pallet and the pallet outer packaging.

5. The system according to claim 1, wherein the pallet outer packaging is manufactured from a UV protective film.

6. The system according to claim 1, wherein the plastic film of the package outer packaging and/or the plastic film of the pallet outer packaging is printed.

7. The system according to claim 1, wherein the plastic film of the package outer packaging and/or the plastic film of the pallet outer packaging has stretch properties and/or shrink properties.

8. The system according to claim 1, wherein the package outer packaging combines the package sleeves in such manner that in the stacking direction are arranged at least 4.0 package sleeves per cm, in particular at least 4.5 package sleeves per cm, in particular at least 5.0 package sleeves per cm, in particular at least 5.5 package sleeves per cm, in particular at least 6.0 package sleeves per cm, in particular at least 6.5 package sleeves per cm, in particular at least 6.75 package sleeves per cm, in particular at least 7.0 package sleeves per cm, in particular at least 7.25 package sleeves per cm or at least 7.5 package sleeves per cm.

9. A system for packaging a plurality of packages made of package sleeves and a package outer packaging on a pallet, comprising:

the plurality of packages made of package sleeves and a package outer packaging, wherein the package outer packaging encloses the package sleeves, a pallet for stacking the plurality of packages, a pallet outer packaging which encloses the plurality of packages stacked on the pallet, and at least one insert which is arranged under and/or between and/or over the plurality of stacked packages, wherein the package sleeves are manufactured from a composite material, wherein each package sleeve has a front side and a rear side, wherein the front side and the rear side of each package sleeve are separated from one another by folding edges, along which each package sleeve is folded together flat, wherein each package sleeve has two openings, which are arranged on opposing sides of the package sleeves, wherein each package sleeve has a longitudinal seam which connects two edges of the composite material to a circumferential package sleeve, wherein the pallet outer packaging is manufactured from a plastic film, wherein the package outer packaging is manufactured from a plastic film, wherein at least one intermediate layer is provided as the at least one insert which is arranged between a plurality of layers of packages stacked one on top of another on the pallet, wherein the at least one intermediate layer is arranged outside of the package outer packaging, but inside the pallet outer packaging, and wherein at least one intermediate layer comprises a means for absorbing a sterilisation and/or disinfection agent.

* * * * *